US011420819B2

(12) United States Patent
Wolfenden

(10) Patent No.: US 11,420,819 B2
(45) Date of Patent: Aug. 23, 2022

(54) AUTOMATED WASTE COLLECTION SYSTEM

(71) Applicant: Alexandra Wolfenden, Bronte (AU)

(72) Inventor: Alexandra Wolfenden, Bronte (AU)

( * ) Notice: Subject to any disclaimer, the term of this patent is extended or adjusted under 35 U.S.C. 154(b) by 2 days.

(21) Appl. No.: 17/105,134

(22) Filed: Nov. 25, 2020

(65) Prior Publication Data

US 2021/0078797 A1 Mar. 18, 2021

Related U.S. Application Data

(63) Continuation-in-part of application No. 16/459,350, filed on Jul. 1, 2019, now Pat. No. 10,875,708.

(60) Provisional application No. 62/691,851, filed on Jun. 29, 2018.

(51) Int. Cl.
*B65F 1/12* (2006.01)
*B65F 1/14* (2006.01)
*B65F 1/16* (2006.01)

(52) U.S. Cl.
CPC ..... *B65F 1/12* (2013.01); *B65F 1/1426* (2013.01); *B65F 1/1473* (2013.01); *B65F 1/16* (2013.01)

(58) Field of Classification Search
CPC ..... B65F 1/1426; B65F 1/1473; B65F 1/16; B65F 1/1638; B65F 1/1646; B65F 1/12; B65F 9/00; B65F 2210/128; A47G 29/12095
USPC ..... 232/43.1, 43.2; 220/908, 908.1
See application file for complete search history.

(56) References Cited

U.S. PATENT DOCUMENTS 3,859,911 A * 1/1975 Karls ..... B30B 9/3032 100/215
3,861,296 A * 1/1975 Clar ..... B30B 9/3007 100/343
4,609,122 A * 9/1986 Ziegenbein ..... B65F 1/1638 220/211
4,883,189 A * 11/1989 Lobbert ..... A61B 50/36 220/260
5,005,729 A * 4/1991 Hollman ..... A47B 77/18 220/23.83
5,137,212 A * 8/1992 Fiterman ..... B65F 1/10 109/46
7,708,188 B2 * 5/2010 Stravitz ..... B65F 1/062 232/43.2
8,678,219 B1 * 3/2014 Wang ..... B65F 1/163 220/211

(Continued)

*Primary Examiner* — William L Miller

(57) ABSTRACT

An automated waste collection has a housing, within which is disposed a deployment mechanism for receiving a waste receptacle. The waste receptacle may be placed onto the deployment mechanism through an access opening traversing through the housing and selectively obstructed by an access closure. Waste may be deposited within the waste receptacle through a lid opening at a top of the housing. The deployment mechanism may be displaced by a deployment actuator between a stored position within the housing and a deployed position external to the housing. In order to do so, the deployment mechanism traverses through a deployment opening selectively obstructed by a deployment closure. A housing controller operates according to a predetermined waste collection schedule, actuating the deployment actuator at any scheduled waste collection times. The waste receptacle further has a set of motorized wheels that enable autonomous navigation from the housing to a collection position.

15 Claims, 12 Drawing Sheets

(56) References Cited

U.S. PATENT DOCUMENTS

| | | | | |
|---|---|---|---|---|
| 9,027,779 | B2 * | 5/2015 | Friedman | B65F 1/06 220/495.11 |
| 10,654,648 | B1 * | 5/2020 | Rodriguez | B65F 1/1436 |
| 10,988,310 | B2 * | 4/2021 | Moore | A47L 5/38 |
| 2007/0182551 | A1 * | 8/2007 | Yang | B65F 1/08 340/545.3 |
| 2007/0266637 | A1 * | 11/2007 | McGowan | B65F 1/1638 49/349 |
| 2009/0057317 | A1 * | 3/2009 | Wang | B65F 1/1426 220/495.06 |
| 2013/0002100 | A1 * | 1/2013 | Badri | A47B 77/18 312/212 |
| 2013/0278067 | A1 * | 10/2013 | Poss | H02J 7/35 307/62 |
| 2014/0172174 | A1 * | 6/2014 | Poss | G05B 15/02 700/275 |
| 2014/0305851 | A1 * | 10/2014 | Hubbell | B07C 5/3412 209/583 |
| 2015/0108888 | A1 * | 4/2015 | Galimberti | B65F 1/1646 312/270.3 |
| 2016/0347540 | A1 * | 12/2016 | Skocypec | B65F 1/14 |
| 2017/0090447 | A1 * | 3/2017 | Skocypec | B65B 67/1233 |
| 2019/0270585 | A1 * | 9/2019 | Moore | B65F 1/1426 |

* cited by examiner

AUTOMATED WASTE COLLECTION SYSTEM

The current application is a continuation-in-part (CIP) application and claims a priority to a U.S. non-provisional application Ser. No. 16/459,350 filed on Jul. 1, 2019. The U.S. non-provisional application Ser. No. 16/459,350 claims a priority to a U.S. provisional application Ser. No. 62/691,851 filed on Jun. 29, 2018.

FIELD OF THE INVENTION

The present invention relates generally to waste storage. More particularly, the present invention relates to a device for storing and automatically deploying collected waste for pickup.

BACKGROUND OF THE INVENTION

In present times, individuals may desire a means to automatically deploying their waste receptacles for pick-up. In conventional systems, individuals would often leave out their waste receptacles along the border of their residential/commercial home fronts, curbs, and/or property boundaries for waste pickup. This can be an inconvenience to individuals who forget about their waste-pickup date, and/or for users that are out of town. Additionally, the displaced bins would often be left exposed to the elements, increasing the likelihood for waste receptacle damage/loss. Oftentimes, individuals would store their waste receptacles in weather-proof receptacles, stowed away and exclusive from their residential/commercial home fronts, curbs, and/or property boundaries. This conventional system however, does not address the concerns of missing their schedules pick-up waste date, especially for places with dedicated waste pick-up times for various types of waste materials. The present invention aims to solve these problems. The present invention is incorporated within the user's preferred residential/commercial home front, fence, and/or property boundary for easy waste deposit. Additionally, the present invention is also made out of a durable, robust, and weatherproof material that complements the aesthetic appeal to whatever it is incorporated on. Furthermore, the present invention comprises mechanisms and functions that makes it autonomous and programmable to conform to scheduled waste-pick up dates i.e. daily, weekly, fortnightly, etc. Various embodiments of the present invention can also be colored to indicate the scheduling thereof, and/or to indicate designated waste receptacles based on material wastes such as: paper, plastics, garden refuge, etc. Various embodiments of the present invention can cater to residential/commercial wheelie bin boxes.

Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention

DETAIL DESCRIPTIONS OF THE INVENTION

Figure 1:
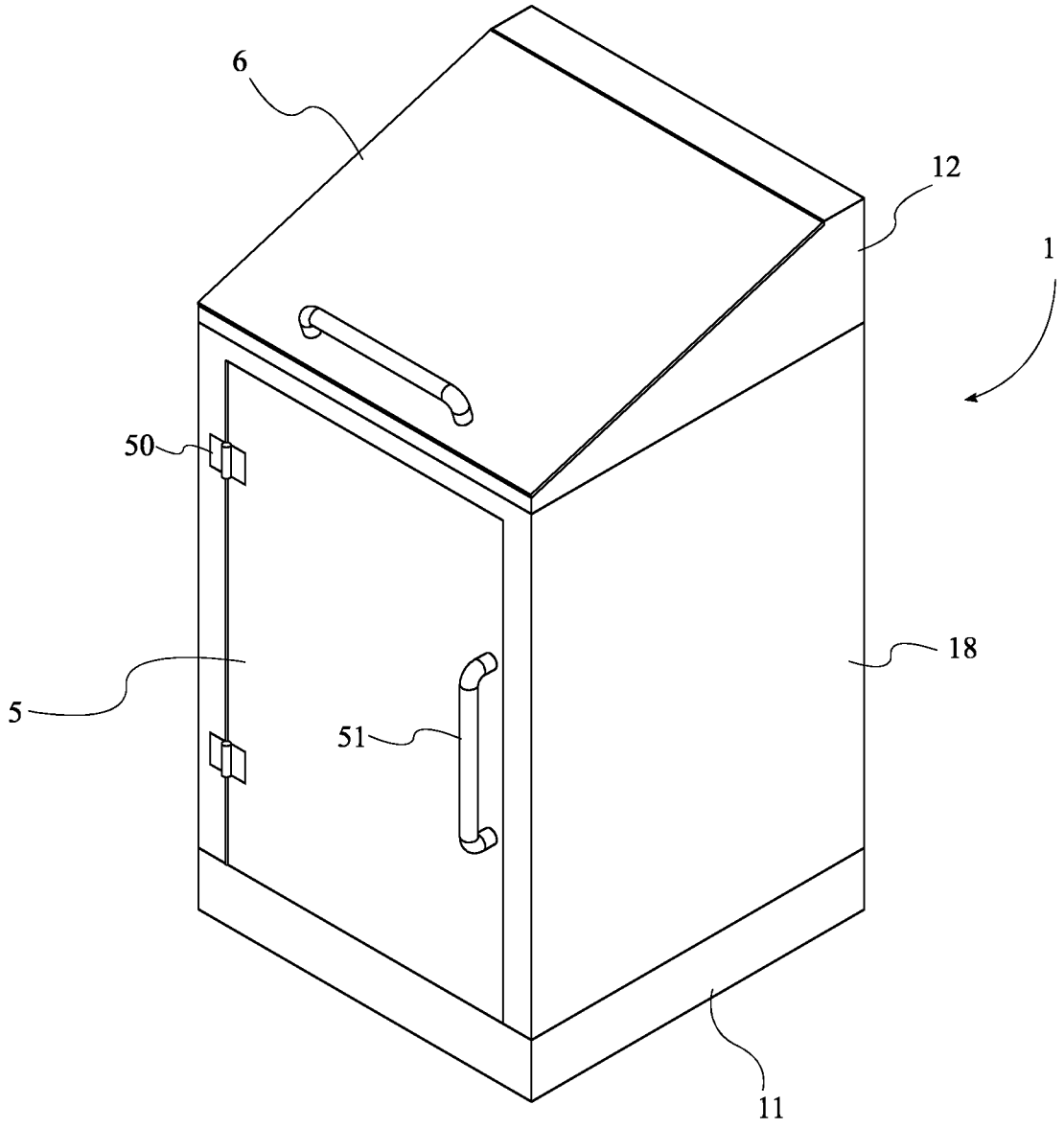
FIG. 1 is a front perspective view of the present invention in accordance with a closed configuration.
Figure 2:
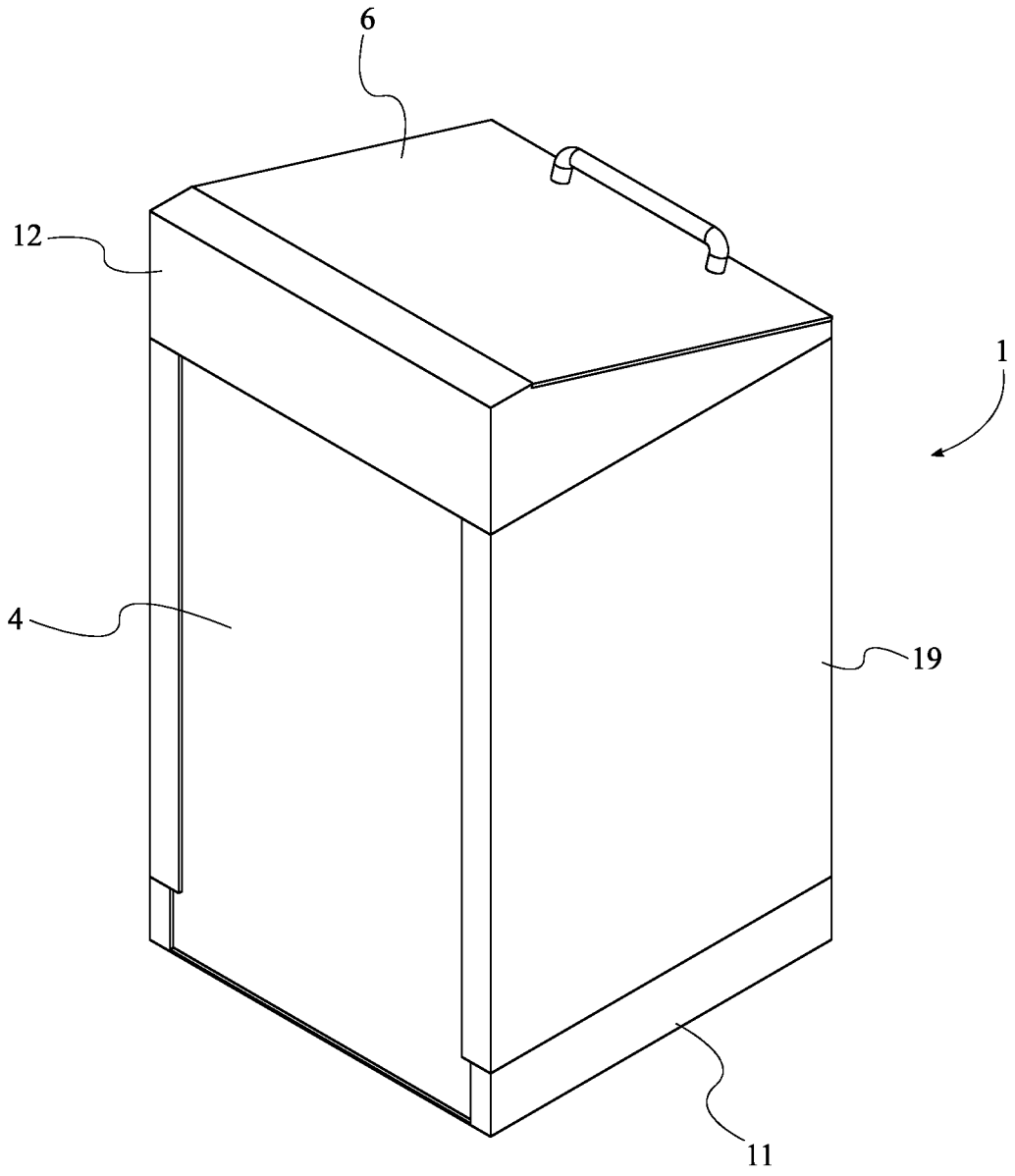
FIG. 2 is a rear perspective view of the present invention in accordance with the closed configuration.
Figure 3:
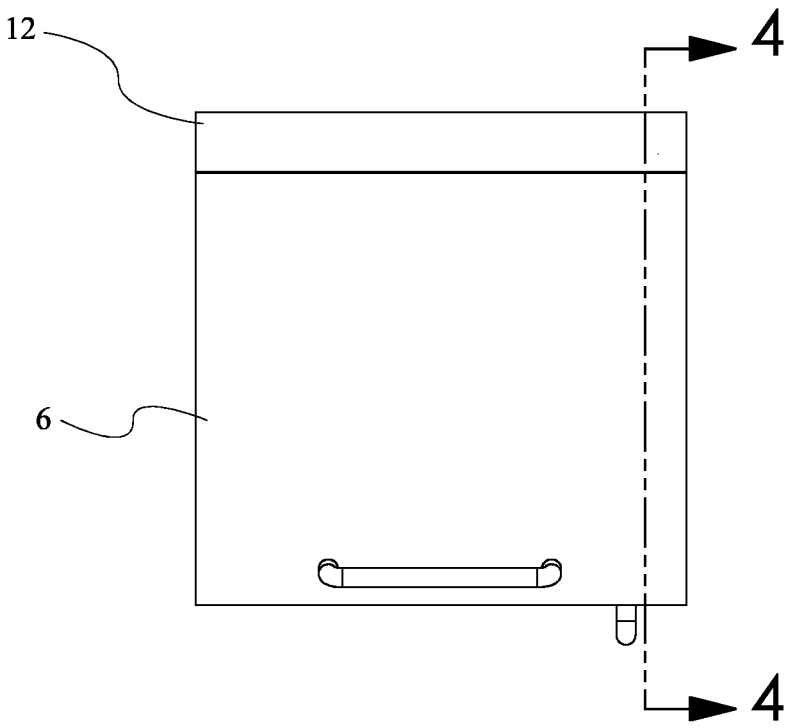
FIG. 3 is a top view of the present invention.
Figure 4:
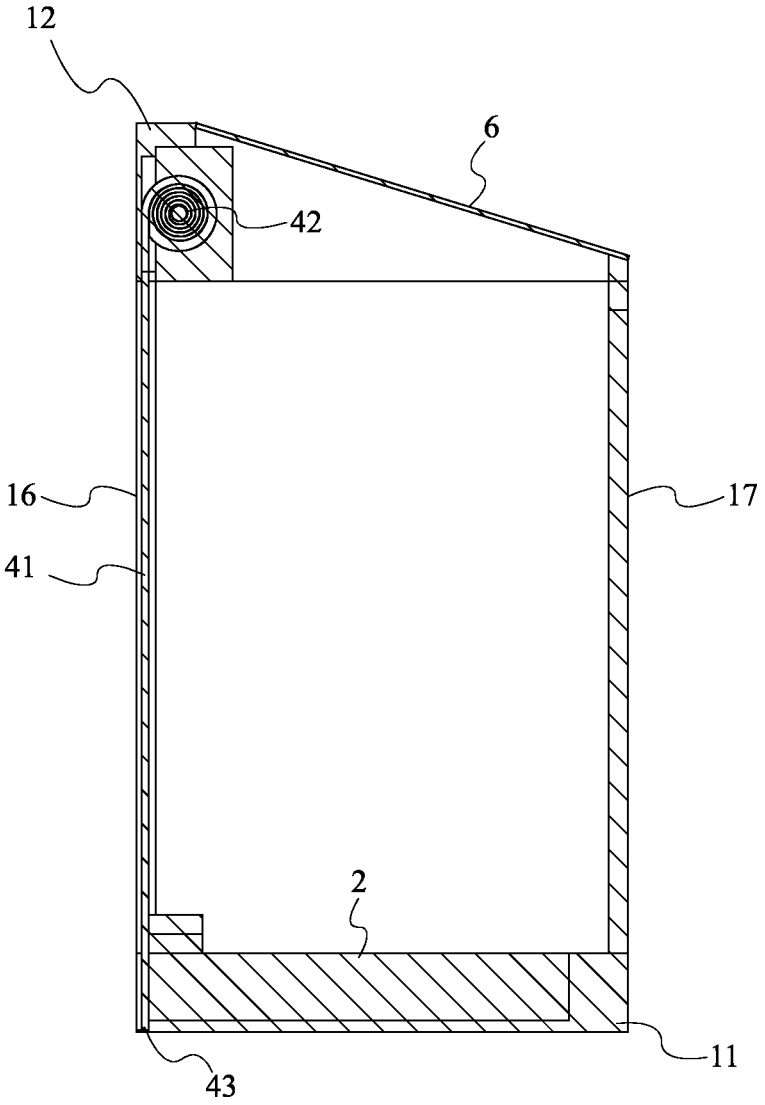
FIG. 4 is a side cross sectional view of the present invention taken along line 4-4 of FIG. 3.
Figure 5:
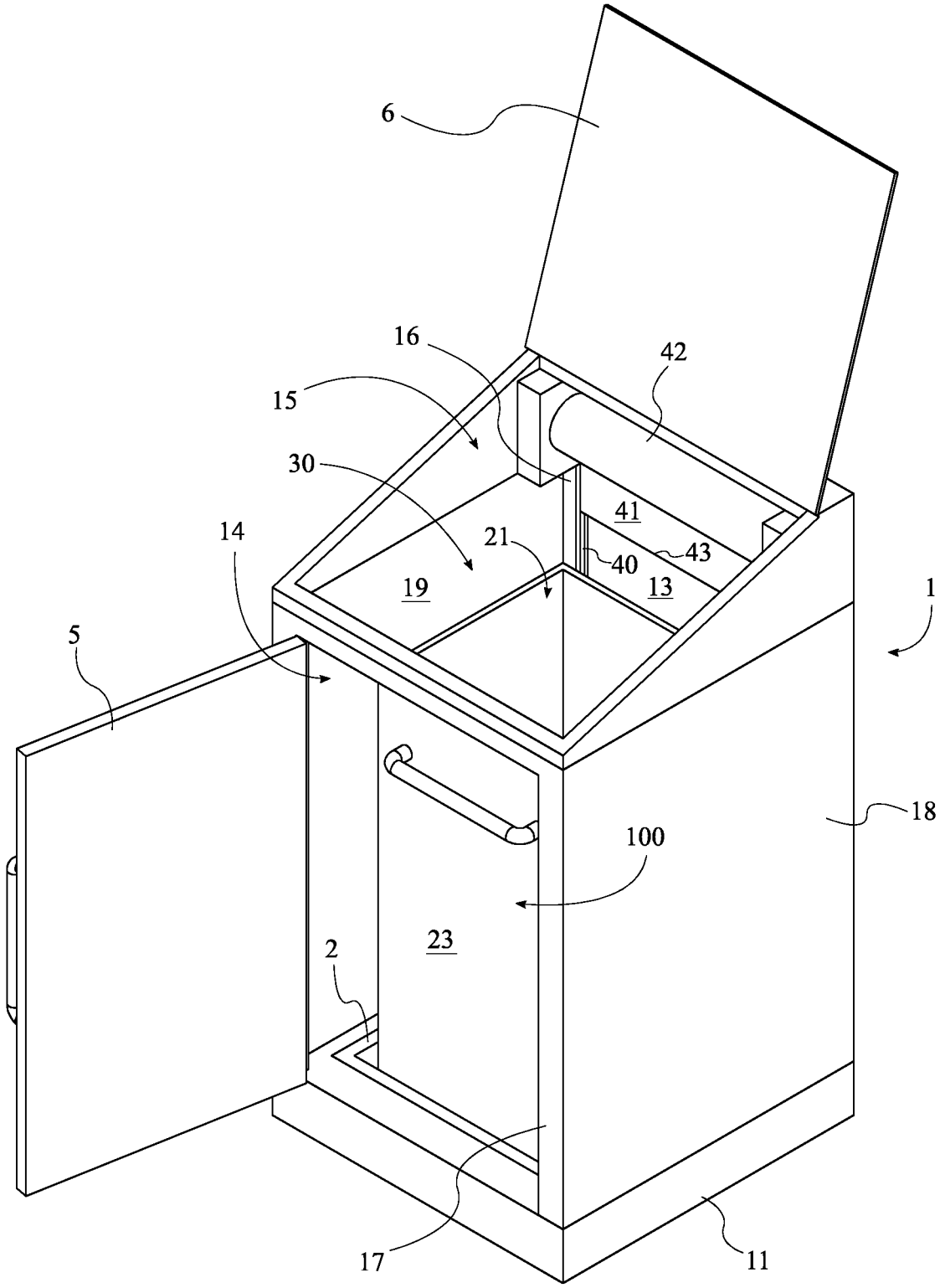
FIG. 5 is a front perspective view of the present invention in accordance with an opened configuration.
Figure 6:
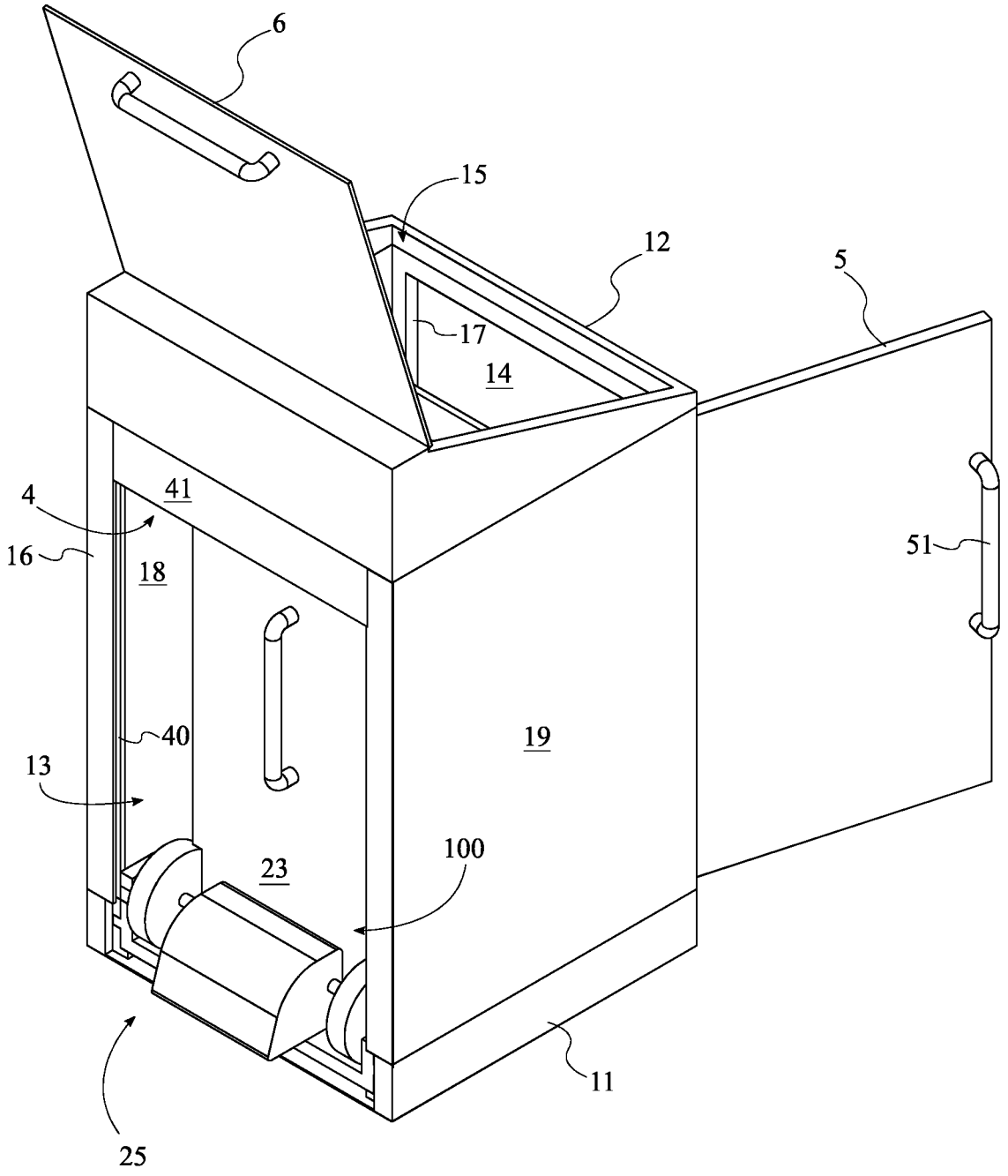
FIG. 6 is a rear perspective view of the present invention in accordance with the opened configuration.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References hereinto "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

The present invention is an automated waste collection system. Moreover, the present invention is an enclosure within which users may shelter a waste receptacle or other compatible receptacle for waste storage and that automatically deploys said receptacle for waste collection according to a designated waste collection schedule.

Referring to FIGS. 1-8 and 10, the preferred embodiment of the present invention comprises a waste receptacle 30, a housing 1, a deployment mechanism 2, a deployment actuator 3, a deployment closure 4, an access closure 5, a lid 6, a housing controller 7, and a housing power source 8.

The housing 1 is the main structural element of the present invention, and is generally constructed of any robust, weather-proof material that may complement the user's preference. In the preferred embodiment, the housing 1 comprises a base 11, a top 12, a deployment opening 13, an access opening 14, and a lid opening 15. The top 12 is positioned vertically opposite the base 11 along the housing 1. The deployment opening 13 and the access opening 14 traverse longitudinally through the housing 1 between the base 11 and the top 12. Furthermore, the deployment opening 13 and the lid opening 15 are positioned longitudinally opposite each other along the housing 1. The lid opening 15 traverses through the top 12.

The deployment closure 4 is connected to the housing 1 adjacent to the deployment opening 13. The deployment closure 4 is configured to selectively obstruct the deployment opening 13; thus, the deployment closure 4 may be opened or closed in order to reveal or obstruct the deployment opening 13. Similarly, the access closure 5 is connected to the housing 1 adjacent to the access opening 14, wherein the access closure 5 is configured to selectively obstruct the access opening 14. The lid 6 is positioned adjacent to the lid opening 15, wherein the lid 6 is configured to selectively obstruct the lid opening 15. In the preferred embodiment, the lid 6 is hingedly connected to the top 12 of the housing 1. In alternate embodiments, the lid 6 may not be permanently affixed to the housing 1 and may be lifted off the housing 1 in order to reveal the lip opening of the top 12.

In various embodiments, the deployment mechanism 2 may be any mechanism or means through which a waste receptacle may be received interior to the housing 1 and deployed external to the housing 1. In the preferred embodiment of the present invention, the deployment mechanism 2 is a deployment tray and is a generally flat component intended to receive and support the waste receptacle 30. The waste receptacle 30 is removably positioned in a home position 400 on the deployment mechanism 2. With the waste receptacle 30 placed onto the deployment mechanism 2 within the housing 1, a user may lift the lid 6 in order to place waste into the waste receptacle 30 through the lid opening 15. The deployment mechanism 2 is positioned adjacent to the base 11, and is operatively engaged with the housing 1 between a stored position 100 and a deployed position 200 as seen in FIGS. 5-8, wherein the deployment mechanism 2 is positioned within the housing 1 in the stored position 100, wherein the deployment mechanism 2 is positioned external to the housing 1 in the deployed position 200, wherein the deployment mechanism 2 traverses through the deployment opening 13 between the stored position 100 and the deployed position 200, and wherein the deployment mechanism 2 is configured to displace the waste receptacle 30 through the deployment opening 13 between the stored position 100 and the deployed position 200. More particularly, in embodiments wherein the deployment mechanism 2 is a deployment tray, the deployment tray is slidably engaged with the housing 1 between the stored position 100 and the deployed position 200, wherein the deployment tray is positioned within the housing 1 in the stored position 100, wherein the deployment tray is positioned external to the housing 1 in the deployed position 200, and wherein the deployment tray traverses through the deployment opening 13 between the stored position 100 and the deployed position 200.

Figure 7:
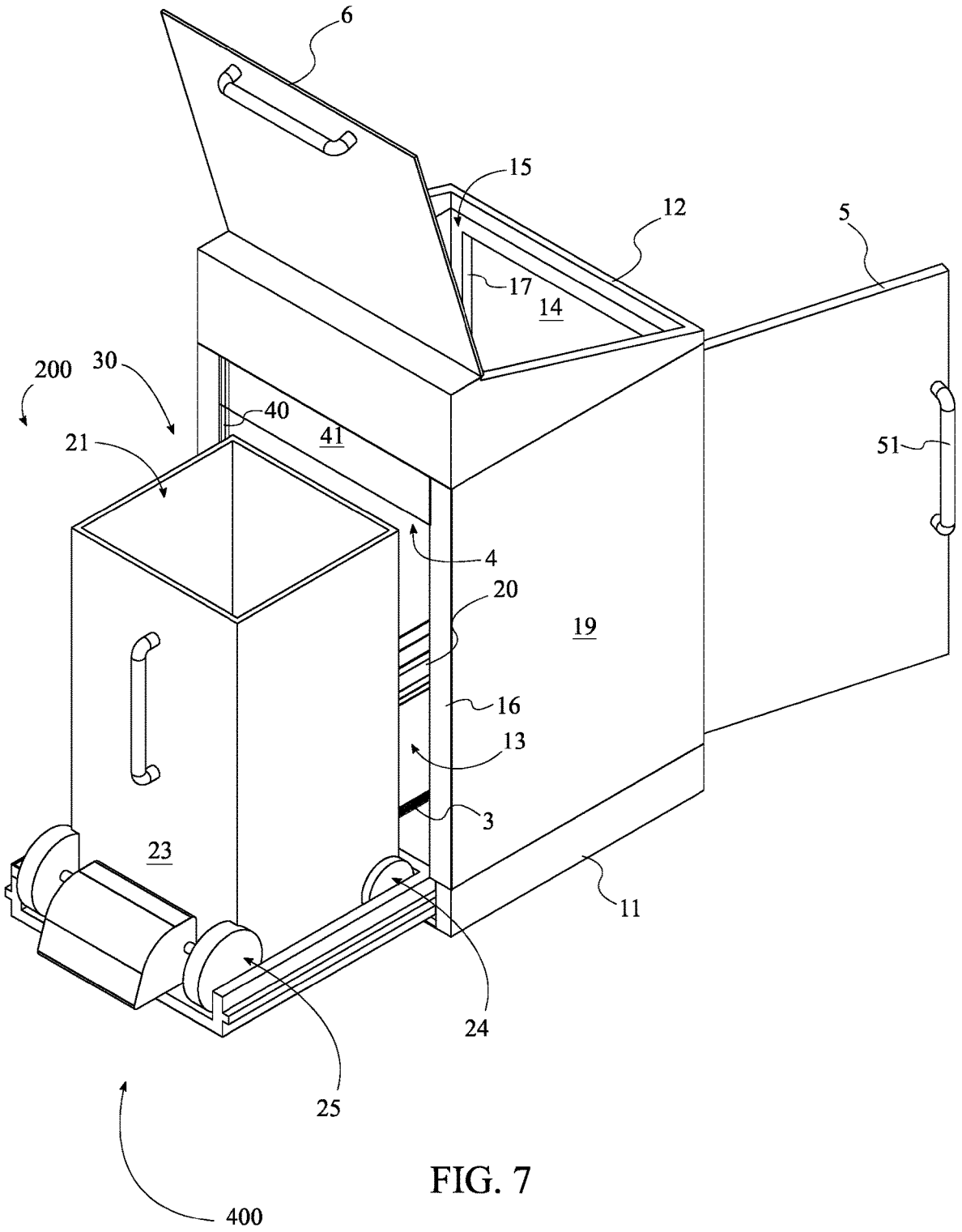
FIG. 7 is a rear raised perspective view of the present invention in accordance with an opened and deployed configuration.
Figure 8:
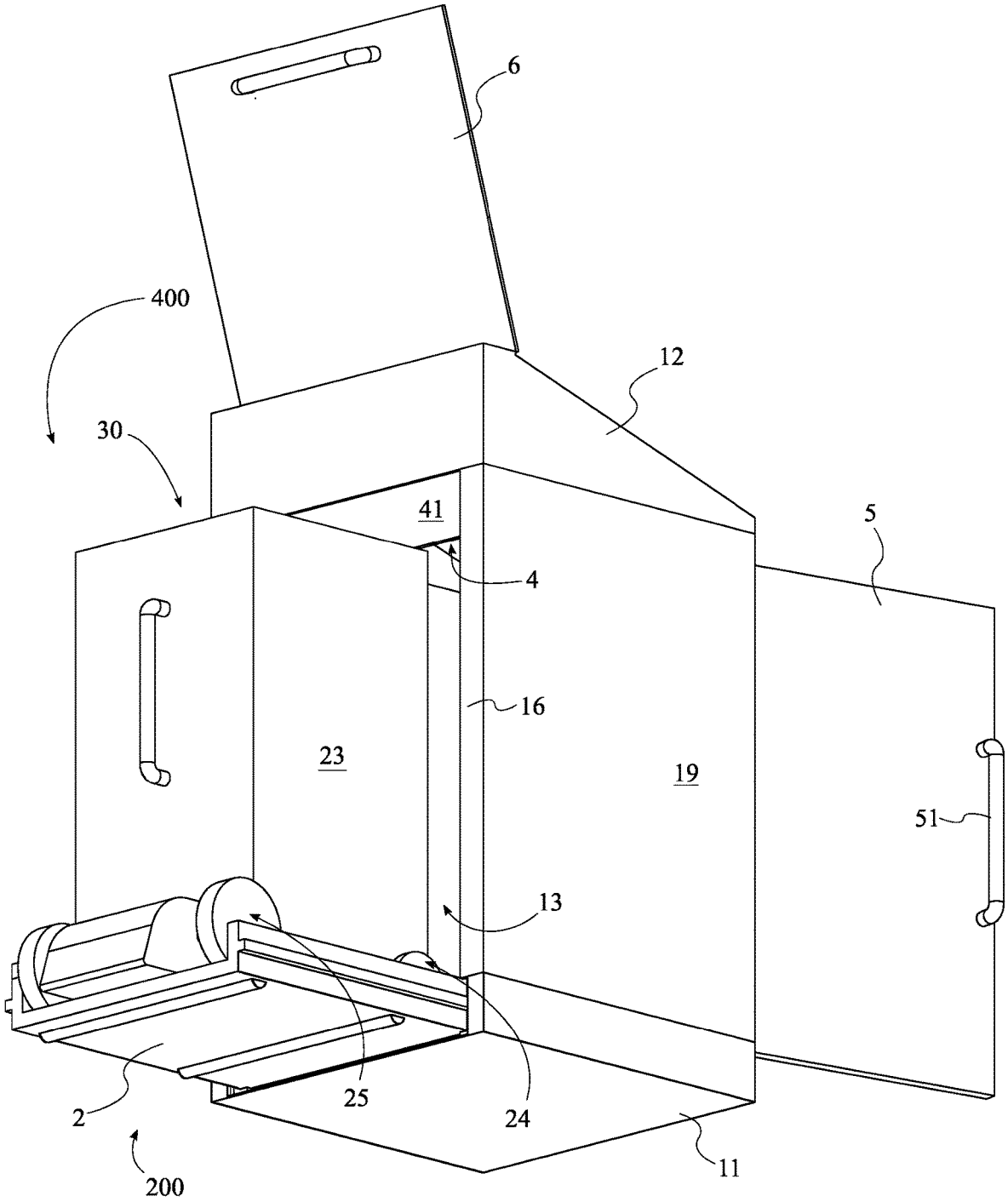
FIG. 8 a rear lowered perspective view of the present invention in accordance with the opened and deployed configuration.

The deployment actuator 3 is operatively engaged between the housing 1 and the deployment mechanism 2, such that the deployment actuator 3 is configured to longitudinally displace the deployment mechanism 2 between the stored position 100 and the deployed position 200. The deployment actuator 3 may take any form of actuator capable of fulfilling the aforementioned purpose, such as, but not limited to, one or more roller actuators, a linear actuator, or other variants of actuators. Furthermore, more than one deployment actuator 3 or combinations of different variations of actuators may be utilized to serve said purpose in various embodiments as known to those skilled in the art. The deployment mechanism 2 may further comprise rollers connected to the underside of the deployment mechanism 2 in order to aid its movement and reduce friction with the base 11. In some embodiments, the deployment actuator 3 may be a linear actuator utilizing a lead screw driven by a motor and engaged with the deployment tray in order to extend and retract the deployment tray, as illustrated in FIG. 7.

Figure 10:
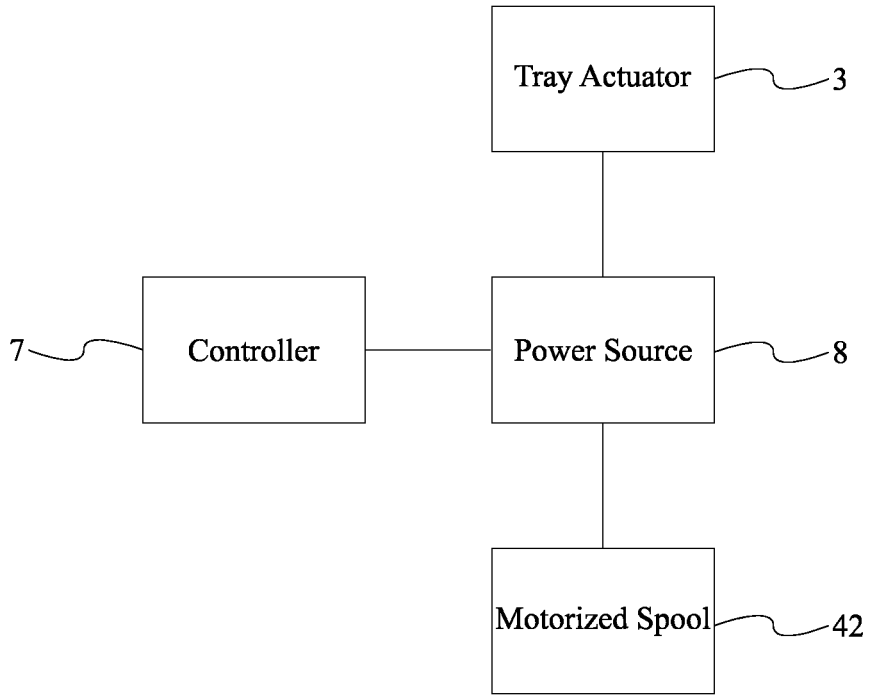
FIG. 10 is a diagram depicting the electronic components of the housing of the present invention in the preferred embodiment.

In reference to FIG. 10, the housing power source 8 may be any available and applicable housing power source 8, such as, but not limited to, a rechargeable and/or removable battery, or a wired connection to a typical household electrical socket, or other applicable housing power sources. The housing power source 8 is electrically connected to the deployment actuator 3 and the housing controller 7, and to any other electrical components of the present invention which require electrical power to operate. More than one housing power source 8 may be utilized for different components of the present invention as desired.

The housing controller 7 is the electronic control and communication processing center of the present invention, comprising one or more electrical, electronic and/or processing devices such as, but not limited to, printed circuit boards (PCBs), microcontrollers, integrated circuits, resistors, capacitors, or any other electrical or electronic components suitable for facilitating the purpose of the present invention. The housing controller 7 is electronically connected to the deployment actuator 3 and to any other electrical or electronic components of the present invention which may require electrical or electronic control.

It is contemplated while the housing 1 may take any form suitable to facilitating the purpose of the present invention, in the preferred embodiment the base 11 further comprises a deployment frame 16, an access frame 17, a first lateral wall 18, and a second lateral wall 19. The deployment frame 16, the access frame 17, the first lateral wall 18, and the second lateral wall 19 are connected between the base 11 and the top 12. In some embodiments, the deployment frame 16 and the access frame 17 are oriented parallel to each other, while the first lateral wall 18 and the second lateral wall 19 are oriented parallel to each other. In some embodiments, the first lateral wall 18 and the second lateral wall 19 are perpendicularly and terminally connected between the deployment frame 16 and the access frame 17. The deployment closure 4 traverses through the deployment frame 16, and the access closure 5 traverses through the access frame 17.

In various embodiments, the particular means through which the deployment mechanism 2 is displaced between the stored position 100 and the deployed position 200 may vary. However, in the preferred embodiment, to this end, the present invention further comprises a plurality of rails 20. The plurality of rails 20 is oriented longitudinally and connected within the housing 1. In embodiments where the deployment mechanism 2 comprises a deployment tray, the deployment mechanism 2 is slidably engaged with the plurality of rails 20, such that the deployment mechanism 2 is displaced between the stored position 100 and the deployed position 200 along the plurality of rails 20. In the preferred embodiment, each of the plurality of rails 20 is laterally connected internal to the base 11. More particularly, in the preferred embodiment, the plurality of rails 20 is a pair of rails that is positioned laterally opposite each other along the base 11.

The preferred embodiment of the present invention further comprises at least one closure hinge 50. The at least one closure hinge 50 is connected to the access frame 17 of the housing 1 adjacent to the access opening 14, and the access closure 5 is hingedly connected to the housing 1 through the at least one closure hinge 50, forming a door closure through which the access opening 14 may be revealed or obstructed. Furthermore, a closure handle 51 is connected to the access closure 5 and positioned external to the housing 1, enabling a user to easily manipulate the access closure 5 about the at least one closure hinge 50.

In some embodiments, the deployment closure 4 is an unfurling closure comprising a closure body 41 and a motorized spool 42. The closure body 41 is deployably wound around the motorized spool 42, wherein the motorized spool 42 is configured to selectably deploy or retract the closure body 41 in order to obstruct or reveal the deployment opening 13, respectively. The motorized spool 42 is configured to reversibly rotate about its axis in order to deploy and retract the closure body 41. The motorized spool 42 is electrically connected to the housing power source 8, and the motorized spool 42 is electronically connected to the housing controller 7. Thus, the housing controller 7 may actuate the motorized spool 42 in order to deploy or retract the closure body 41 in order to obstruct or reveal the deployment opening 13, respectively. In the preferred embodiment, the motorized spool 42 is laterally mounted within the housing 1 adjacent to the deployment frame 16 and adjacent to the top 12 of the housing 1. Thus, the deployment closure 4 opens and closes in a manner similar to a typical garage door. In order for the closure body 41 to be wound around the motorized spool 42, the closure body 41 may be made of a flexible, yet durable material, or the closure body 41 may consist of a plurality of segments rotatably, terminally and serially connected to each other, or through another viable means.

In the preferred embodiment, in order to support the intended operation of the deployment closure 4, the deployment frame 16 comprises a pair of tracks 40. The pair of tracks 40 traverses into the deployment frame 16 between the top 12 and the base 11 and is positioned laterally opposite each other along the deployment frame 16. A distal end 43 of the closure body 41, which is opposite the motorized spool 42 along the closure body 41, is positioned within the pair of tracks 40, wherein the motorized spool 42 is configured to displace the distal end 43 of the closure body 41 toward the base 11 within the pair of tracks 40 in order to obstruct the deployment opening 13, and vice versa to reveal the deployment opening 13.

Figure 11:
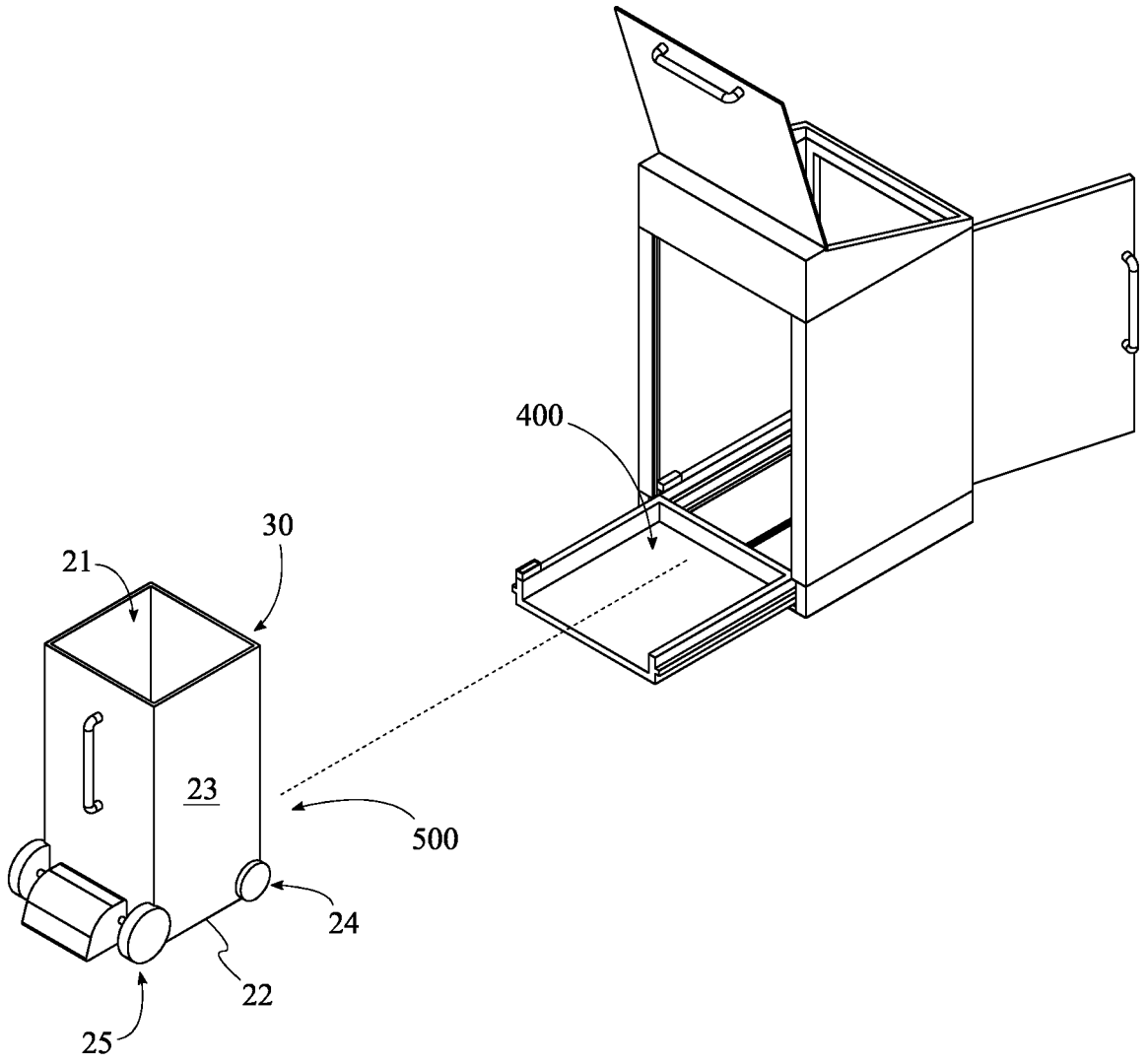
FIG. 11 is a front raised perspective view of the waste receptacle in the collection position.
Figure 12:
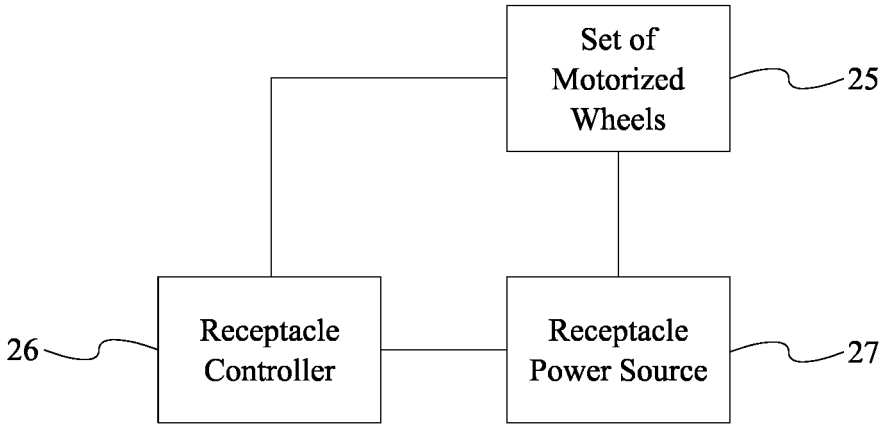
FIG. 12 is a diagram depicting the electronic components of the waste receptacle of the present invention in the preferred embodiment.

Referring to FIGS. 11-12, The waste receptacle 30 may be any current or new waste receptacle as desired in different embodiments. In the preferred embodiment, in addition to deploying the waste receptacle 30 into the deployed position 200 from within the housing 1, the waste receptacle 30 is capable of autonomously propelling itself from the housing 1 to a collection position 500, such as a curb, in order to accommodate residences whose waste receptacles are required to be positioned at such a collection position 500 in order to be collected by waste management workers. As previously mentioned, the waste receptacle 30 will be positioned on the deployment mechanism 2 in the home position 400 much of the time in order to receive waste discarded by a user. In the preferred embodiment of the present invention, the waste receptacle 30 is capable of autonomously moving from the home position 400 to the collection position 500. In some embodiments, the waste receptacle 30 may also be capable of returning from the collection position 500 to the home position 400. This movement of the waste receptacle 30 between the home position 400 and the collection position 500 may be programmed according to a set schedule, or may be manually initiated by a user through an electronic connection between a user interface such as, but not limited to, a computing device, physical switch, or another applicable type of user interface in different embodiments as desired. In some embodiments, this action may be facilitated over a wireless network, through a wireless communication device, or through a wired electronic connection. In the preferred embodiment of the present invention, referring to FIG. 6, the waste receptacle 30 comprises an opening 21, a bottom 22, a body 23, a set of free wheels 24, a set of motorized wheels 25, a receptacle controller 26, and a receptacle power source 27. The opening 21 and the bottom 22 are positioned vertically opposite each other along the body 23. The set of free wheels 24 and the set of motorized wheels 25 are connected to the bottom 22, and are positioned longitudinally opposite each other along the bottom 22. The receptacle power source e is electronically connected to the receptacle controller 26 and the set of motorized wheels 25, and the receptacle controller 26 is electronically connected to the set of motorized wheels 25. The receptacle controller 26 may further be electronically connected to a wireless communication device, or another electronic communication means, as applicable in various embodiments.

The receptacle controller 26 is configured to actuate the set of motorized wheels 25 in order to propel the waste receptacle 30 between the home position 400 and the collection position 500, wherein the collection position 500 is defined by a specified distance from the home position 400 through the receptacle controller 26. However, it should be understood that any desired method may be utilized to propel the waste receptacle 30 between the home position 400 and the collection position 500 as desired in various embodiments. For example, the home position 400 and the collection position 500 may be defined by preset coordinates, or through a predefined movement action or sequence of actions of the set of motorized wheels 25, or through another method.

In the preferred embodiment, the set of motorized wheels 25 is positioned at a front end of the waste receptacle 30, such that the set of motorized wheels 25 functions to pull instead of push the waste receptacle 30 from the home position 400 to the collection position 500 for stability of movement. In such embodiments, the receptacle controller 26 may be configured to only propel the waste receptacle 30 from the home position 400 to the collection position 500, and not vice versa, as the intent of the present invention is primarily focused on presenting the waste receptacle 30 for waste management workers to empty, due to waste collection being an event that happens on a schedule, and the user may manually return the waste receptacle 30 to the housing 1 at their leisure. In some embodiments, the set of free wheels 24 may be replaced by a second set of motorized wheels in order to further facilitate stability of movement and control of the waste receptacle 30 in transit and to enable the waste receptacle 30 to autonomously return to the home position 400 from the collection position 500 in addition to moving from the home position 400 to the collection position 500.

The general process of use of the present invention is as follows. The user manually opens the access closure 5 and places a waste receptacle 30 into the deployment mechanism 2 through the access opening 14. Then, the user may open the lid 6 and place waste into the waste receptacle 30 through the lip opening at the top 12 of the housing 1. A predetermined deployment schedule may be established through a variety of means. For example, a wireless communication device may further be comprised in the present invention in order to facilitate electronic communication of the housing controller 7 with a mobile application of the user's mobile device or desktop computer, or with a remote server, or other means of control. The user may be able to input the deployment schedule through an interface of the mobile or desktop application, web browser, or similar means, or the deployment schedule may be received electronically from a third party.

Alternatively or additionally, the user may be enabled to input a command through the mobile application or other interface in order to deploy the deployment mechanism 2 at any time. The deployment schedule may comprise one or more deployment date-and-times. At each deployment date-and-time, the housing controller 7 actuates the motorized spool 42 in order to retract the closure body 41 of the deployment closure 4, revealing the deployment opening 13. Subsequently, the housing controller 7 actuates the deployment actuator 3 in order to displace the deployment mechanism 2 into the deployed position 200, exposing the waste receptacle 30. Next, the receptacle controller 26 actuates the set of motorized wheels 25 in order to propel the waste receptacle 30 off the deployment mechanism 2 and to the collection position 500.

Figure 9:
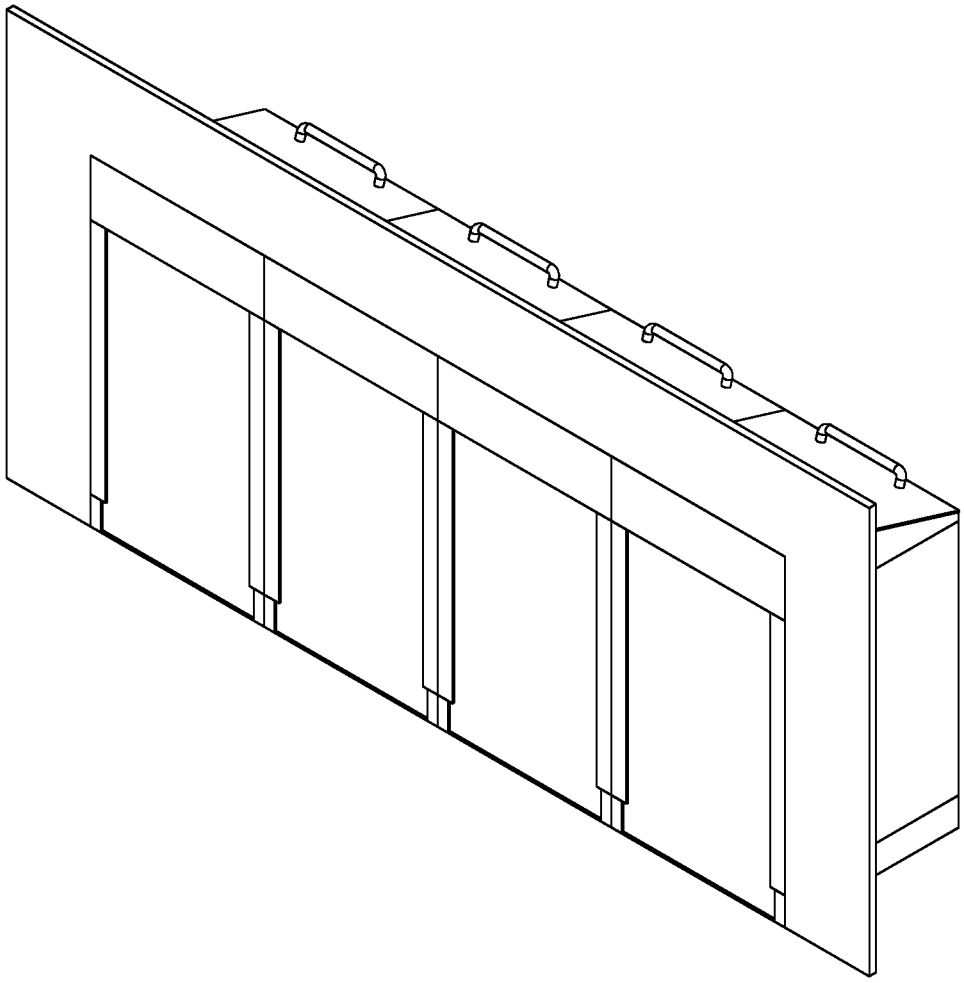
FIG. 9 is a rear raised perspective view of multiple instances of the present invention installed into a wall.

It may be further noted herein that multiple instances of the present invention may be arranged along a wall, fence or other boundary of the user's residential home front or commercial property, or in any other desired location, as illustrated in FIG. 9.

Although the invention has been explained in relation to its preferred embodiment, it is to be understood that many other possible modifications and variations can be made without departing from the spirit and scope of the invention as hereinafter claimed.

What is claimed is:

1. An automated waste collection system comprising:

a waste receptacle;

a housing;

a deployment mechanism;

a deployment actuator;

a deployment closure;

an access closure;

a lid;

the housing comprising a base, a top, a deployment opening, an access opening, and a lid opening;

the deployment opening and the access opening traversing through the housing between the base and the top;

the deployment closure being connected to the housing adjacent to the deployment opening, wherein the deployment closure is configured to selectively obstruct the deployment opening;

the access closure being connected to the housing adjacent to the access opening, wherein the access closure is configured to selectively obstruct the access opening;

the waste receptacle being removably positioned in a home position on the deployment mechanism;

the deployment mechanism being operatively engaged with the housing between a stored position and an deployed position, wherein the deployment mechanism is positioned within the housing in the stored position, wherein the deployment mechanism is positioned external to the housing in the deployed position, wherein the deployment mechanism is configured to displace the waste receptacle through the deployment opening between the stored position and the deployed position;

the deployment actuator being operatively engaged between the housing and the deployment mechanism, wherein the deployment actuator is configured to longitudinally displace the deployment mechanism between the stored position and the deployed position;

the waste receptacle comprising an opening, a bottom, a body, a set of free wheels, a set of motorized wheels, a receptacle controller, and a receptacle power source;

the opening and the bottom being positioned vertically opposite each other along the body;

the set of free wheels and the set of motorized wheels being connected to the bottom;

the set of free wheels and the set of motorized wheels being positioned longitudinally opposite each other along the bottom;

the receptacle power source being electrically connected to the receptacle controller and the set of motorized wheels;

the receptacle controller being electronically connected to the set of motorized wheels; and the receptacle controller being configured to actuate the set of motorized wheels in order to propel the waste receptacle between the home position and a collection position, wherein the home position is located on the deployment mechanism, and wherein the collection position is defined by a specified distance from the home position through the receptacle controller.

2. The automated waste collection system as claimed in claim 1 comprising:

the top being positioned opposite the base along the housing;

the lid opening traversing through the top;

the lid being positioned adjacent to the lid opening, wherein the lid is configured to selectively obstruct the lid opening; and the deployment opening and the lid opening being positioned longitudinally opposite each other along the housing.

3. The automated waste collection system as claimed in claim 1 comprising:

a housing controller;

a housing power source;

the housing power source being electrically connected to the deployment actuator and the housing controller; and the housing controller being electronically connected to the deployment actuator.

4. The automated waste collection system as claimed in claim 3 comprising:

the deployment closure comprises at least one a motorized door, wherein the at least one motorized door is configured to move between a closed position and an opened position, wherein the deployment closure is obstructed by the at least one motorized door in the closed position;

the motorized door being electrically connected to the housing power source; and the motorized door being electronically connected to the housing controller.

5. The automated waste collection system as claimed in 4 comprising:

the deployment frame comprises a pair of hinges;

the at least one motorized door comprises a pair of motorized doors;

the pair of hinges being connected to the deployment frame between the top and the base;

the pair of hinges being positioned laterally opposite each other along the deployment frame; and each of the pair of motorized doors being hingedly connected to the deployment frame through one of the pair of hinges.

6. The automated waste collection system as claimed in claim 1 comprising:

the deployment mechanism being a deployment tray;

the deployment tray being positioned adjacent to the base;

the deployment tray being slidably engaged with the housing between a stored position and an deployed position, wherein the deployment tray is positioned within the housing in the stored position, wherein the deployment tray is positioned external to the housing in the deployed position, and wherein the deployment tray traverses through the deployment opening between the stored position and the deployed position; and the deployment actuator being operatively engaged between the housing and the deployment tray, wherein the deployment actuator is configured to longitudinally displace the deployment tray between the stored position and the deployed position.

7. The automated waste collection system as claimed in claim 1 comprising:

the housing further comprises a deployment frame, an access frame, a first lateral wall, and a second lateral wall;

the deployment frame, the access frame, the first lateral wall, and the second lateral wall being connected between the base and the top;

the deployment frame and the access frame being oriented parallel to each other;

the first lateral wall and the second lateral wall being oriented parallel to each other;

the first lateral wall and the second lateral wall being perpendicularly and terminally connected between the deployment frame and the access frame;

the deployment closure traversing through the deployment frame; and the access closure traversing through the access frame.

8. The automated waste collection system as claimed in claim 7 comprising:

the deployment closure comprises a closure body and a motorized spool, wherein the deployment closure is an unfurling closure;

the closure body being deployably wound around the motorized spool, wherein the motorized spool is configured to deploy the closure body in order to obstruct the deployment opening, and wherein the motorized spool is configured to reversibly rotate in order to deploy and retract the closure body;

the motorized spool being electrically connected to a housing power source; and the motorized spool being electronically connected to a housing controller.

9. The automated waste collection system as claimed in claim 8 comprising:

the motorized spool being laterally mounted within the housing adjacent to the deployment frame and adjacent to the top.

10. The automated waste collection system as claimed in claim 9 comprising:

the deployment frame comprises a pair of tracks;

the pair of tracks traversing into the deployment frame between the top and the base;

the pair of tracks being positioned laterally opposite each other along the deployment frame; and a distal end of the closure body being positioned within the pair of tracks, wherein the motorized spool is configured to displace the distal end of the closure body toward the base within the pair of tracks in order to obstruct the deployment opening.

11. The automated waste collection system as claimed in claim 1 comprising:

the lid being hingedly connected to the top, wherein the lid is configured to selectively obstruct the lid opening.

12. The automated waste collection system as claimed in claim 1 comprising:

a plurality of rails;

the deployment mechanism being a deployment tray;

the plurality of rails being oriented longitudinally and connected within the housing; and the deployment tray being slidably engaged with the plurality of rails, wherein the deployment tray is displaced between the stored position and the deployed position along the plurality of rails.

13. The automated waste collection system as claimed in claim 12 comprising:

each of the plurality of rails being laterally connected internally to the base.

14. The automated waste collection system as claimed in claim 1 comprising:

at least one closure hinge;

the at least one closure hinge being connected to an access frame of the housing adjacent to the access opening; and the access closure being hingedly connected to the housing through the at least one closure hinge.

15. The automated waste collection system as claimed in claim 1 comprising:

a closure handle;

the closure handle being connected to the access closure; and the closure handle being positioned external to the housing.

* * * * *